US005907955A

United States Patent [19]

Park

[11] Patent Number: 5,907,955

[45] Date of Patent: Jun. 1, 1999

[54] METHOD FOR REDUCING OPERATING NOISE OF A REFRIGERATOR

[75] Inventor: Hyung Nam Park, Incheon, Rep. of Korea

[73] Assignee: Daewoo Electronics, Co., Ltd., Seoul, Rep. of Korea

[21] Appl. No.: 09/139,702

[22] Filed: Aug. 25, 1998

[30] Foreign Application Priority Data

Aug. 26, 1997 [KR] Rep. of Korea ..... 97-40939

[51] Int. Cl.[6] ..... F25D 17/06

[52] U.S. Cl. ..... 62/131; 62/180; 62/186; 62/229; 62/296

[58] Field of Search ..... 62/131, 179, 180, 62/186, 229, 296, 203, 208, 209, 155, 234, 157, 158

[56] References Cited

U.S. PATENT DOCUMENTS 5,010,739 4/1991 Isshiki et al. ..... 62/296 X
5,203,178 4/1993 Shyu ..... 62/180
5,228,300 7/1993 Shim ..... 62/131 X
5,428,965 7/1995 Grunwald et al. ..... 62/180

*Primary Examiner*—Harry B. Tanner
*Attorney, Agent, or Firm*—Anderson, Kill & Olick, P.C.

[57] ABSTRACT

A method for reducing operating noise of a refrigerator comprises of steps of detecting an exterior temperature of the refrigerator, comparing the detected the exterior temperature with a reference temperature, if the detected exterior temperature is less than or equal to the reference temperature, periodically detecting exterior light levels, determining whether or not an absolute value of the difference between two successive exterior light levels is more than or equal to a reference light level for measuring a variation of the exterior light levels with time, if the absolute value is more than or equal to the first reference light level, deciding whether or not the former is more than the latter, wherein, if the former is less than or equal to the latter, operating the refrigerator in a normal operation mode, and if the former is more than the latter, increasing by a predetermined temperature a first driving reference temperature for driving a first fan for a refrigerator compartment and a second driving reference temperature for driving a compressor and a second fan for a freezer compartment, respectively, and operating the refrigerator at a reduced noise level.

6 Claims, 4 Drawing Sheets

METHOD FOR REDUCING OPERATING NOISE OF A REFRIGERATOR

FIELD OF THE INVENTION

The present invention relates to a refrigerator; and, more particularly, to method for reducing operating noise thereof at nighttime.

BACKGROUND OF THE INVENTION

As is well known, a refrigerator performs a cooling or freezing function through a cooling system thereof. Usually, the cooling system includes three essential elements, namely, an evaporator, a compressor and a condenser. In operation, the compressor compresses a low temperature and low pressure refrigerant gas from the evaporator into a high temperature and high pressure refrigerant gas and the condenser condenses the high temperature and high pressure refrigerant gas from the compressor to a high temperature and high pressure refrigerant liquid. The high temperature and high pressure refrigerant liquid is changed into a low temperature and low pressure refrigerant liquid through an expansion valve, and then flows into the evaporator. The low temperature and low pressure refrigerant liquid absorbs heat from an air around the evaporator, thereby cooling the air. In order to efficiently cool the air to thereby increase the cooling efficiency, one or two fans are usually employed in the refrigerator.

In the refrigerator employing one fan, the operating rates of the fan and the compressor are determined on the basis of the interior temperature of the refrigerator compartment, whereas in the refrigerator employing two fans, those of each of the fans and the compressor are determined by the interior temperature of the refrigerator compartment and the freezer compartment, respectively.

Such refrigerators, however, have a shortcoming in that there is no difference between nighttime and daytime in the level of operating noise produced by the fans and the compressor which constitute the principle sources of refrigerator operating noise, since the refrigerator is incapable of distinguishing whether or not it is nighttime or daytime.

SUMMARY OF THE INVENTION

It is, therefore, a primary object of the invention to provide a method for reducing operating noise of a refrigerator at nighttime by selectively controlling the operating rates of the fans and the compressor.

In accordance with one aspect of the present invention, there is provided method for reducing operating noise of a refrigerator comprising steps of: (a) detecting an exterior temperature; (b) comparing the detected the exterior temperature with a reference temperature; (c) if the detected exterior temperature is less than or equal to the reference temperature, periodically detecting exterior light levels; (d) determining whether or not an absolute value of the difference between two successive exterior light levels is more than or equal to a reference light level to thereby measure a variation of the exterior light levels with time; (e) if the absolute value of the difference between two successive exterior light levels is more than or equal to the first reference light level, deciding whether or not the former is more than the latter, wherein, if the former is less than or equal to the latter, operating the refrigerator in a normal operation mode; and (f) if the former is more than the latter, increasing by a predetermined temperature a first driving reference temperature for driving a first fan for a refrigerator compartment and a second driving reference temperature for driving a compressor and a second fan for a freezer compartment, respectively, and operating the refrigerator at a reduced noise level.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
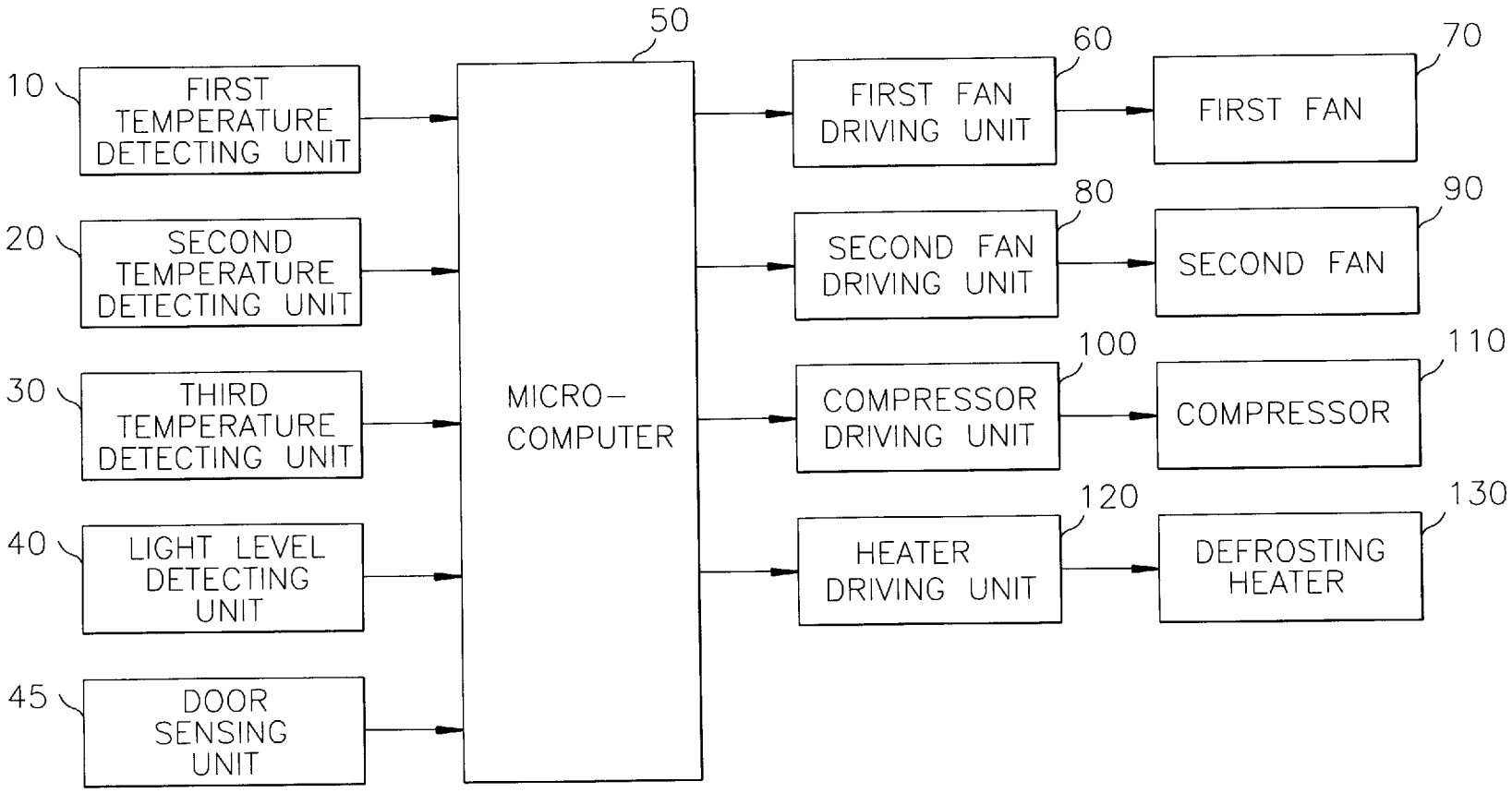
FIG. 1 shows a schematic block diagram of a refrigerator in accordance with the present invention.

Referring to FIG. 1, there is shown a schematic block diagram of a refrigerator capable of being operated at a reduced noise level at nighttime in accordance with the present invention, which includes a first temperature detecting unit 10, a second temperature detecting unit 20, a third temperature detecting unit 30, a light level detecting unit 40, a door sensing unit 45 for sensing whether or not a refrigerator door has been opened and closed, a microcomputer 50, a first fan driving unit 60, a second fan driving unit 80, a first fan 70, a second fan 90, a compressor driving unit 100, a compressor 110, a heater driving unit 120 and a defrosting heater 130.

The first temperature detecting unit 10 disposed at a suitable location in a refrigerator compartment detects an interior temperature thereof and outputs the detected interior temperature value to the microcomputer 50; the second temperature detecting unit 20 installed at a suitable location in a freezer compartment detects an interior temperature thereof and outputs the detected interior temperature value to the microcomputer 50; and the third temperature detecting unit 30 arranged at a suitable location outside the refrigerator detects an exterior temperature and outputs the detected exterior temperature value to the microcomputer 50.

The light level detecting unit 40 disposed at a suitable location outside the refrigerator periodically detects an exterior light level thereof, and outputs the detected light level to the microcomputer 50.

The door sensing unit 45 senses whether or not the refrigerator door has been opened and closed and outputs the sensed result to the microcomputer 50.

The first fan driving unit 60 controlled by the microcomputer 50 outputs a driving signal to the first fan 70 for the refrigerator compartment, selectively. In case that the driving signal from the first fan driving unit 60 is input to the first fan 70, the first fan 70 is activated to force the cooling air around an evaporator (not shown) to the refrigerator compartment.

Similarly to the first fan driving unit 60, the second fan driving unit 80 controlled by the microcomputer 50 outputs a driving signal to the second fan 90 for the freezer compartment, selectively. In case that the driving signal from the second fan driving unit 80 is input to the second fan 90, the second fan 90 is activated to force the cooling air around the evaporator to the freezer compartment.

The compressor driving unit 100 controlled by the microcomputer 50 outputs a driving signal to the compressor 110, selectively. When the compressor 110 receives the driving signal, the compressor 110 compresses the low temperature and low pressure refrigerant gas from the evaporator into the high temperature and high pressure refrigerant gas, flowing it to the condenser (not shown).

The heater driving unit 120 controlled by the microcomputer 50 in the defrosting mode of the refrigerator outputs a driving signal to the defrosting heater 130 mounted at the evaporator, selectively. When the defrosting heater 130 receives the driving signal, the defrosting heater 130 generates heat to remove the frost deposited on the evaporator.

When the refrigerator is in a normal operation mode, the microcomputer 50 compares the interior temperature of the refrigerator compartment detected by the first temperature detecting unit 10 and the interior temperature of the freezer compartment detected by the second temperature detecting unit 20 with a first driving reference temperature for driving the refrigerator compartment and a second driving reference temperature for driving the freezer compartment, respectively. To be more specific, the first driving and the second driving reference temperatures are set by a user so as to select the driving points of the first and the second fans 70, 90, and the compressor 110, respectively, wherein the ranges of the first and the second driving reference temperatures are from about −1° C. to about 0.65° C. and from about −22.5° C. to about −17.5° C., respectively.

Before changing into a defrosting mode, the refrigerator automatically changes its mode to a pre-cool mode. During the pre-cool mode, the compressor 110 is forcibly driven for a predetermined time, and at the defrosting mode, the defrosting heater 130 is activated to remove the frost deposited on the evaporator. The forgoing condition for changing into the defrosting mode is defined by the operating rate of the compressor 110 and the operating time thereof. For example, when the operating rate of the compressor is 80% and the operating time thereof is about 6 hours on the average, the refrigerator is changed into the defrosting mode via the pre-cool mode.

Further, the microcomputer 50 interprets the exterior temperature of the refrigerator detected by the third temperature detecting unit 30 and the exterior light level of the refrigerator detected by the light level detecting unit 40, and then, on the basis of the interpreted results, decides whether it is daytime or nighttime. If the microcomputer 50 recognizes that it is nighttime, the microcomputer 50 resets the first and the second driving reference temperatures so that the first and the second driving reference temperatures are, respectively, increased by 3° C., which, in turn, reduces the operating rate of the first and the second fans 70, 90 and the compressor 130, thereby reducing operating noise thereof.

The microcomputer 50 determines whether or not the refrigerator door has been opened and closed. If the refrigerator door has been opened and closed, the microcomputer 50 reverts the mode of the refrigerator and operates it at the normal operation mode for, e.g., 30 minutes, and then returns the process to step of deciding whether or not it is daytime or nighttime, again. Furthermore, the microcomputer 50 determines whether or not the refrigerator reaches the point for changing into the defrosting mode. Unlike the typical refrigerator, when the refrigerator reaches the point for changing into the defrosting mode, the refrigerator does not start the defrosting function immediately. To be more specific, the microcomputer 50 delays for a predetermined time the start point of the defrosting mode, so that the compressor 110 is allowed to operate at the minimum operating rate at nighttime, which, in turn, allows the refrigerator to operate at the reduced noise level.

The method for reducing operating noise of the refrigerator will now be described in detail.

Figure 2A:
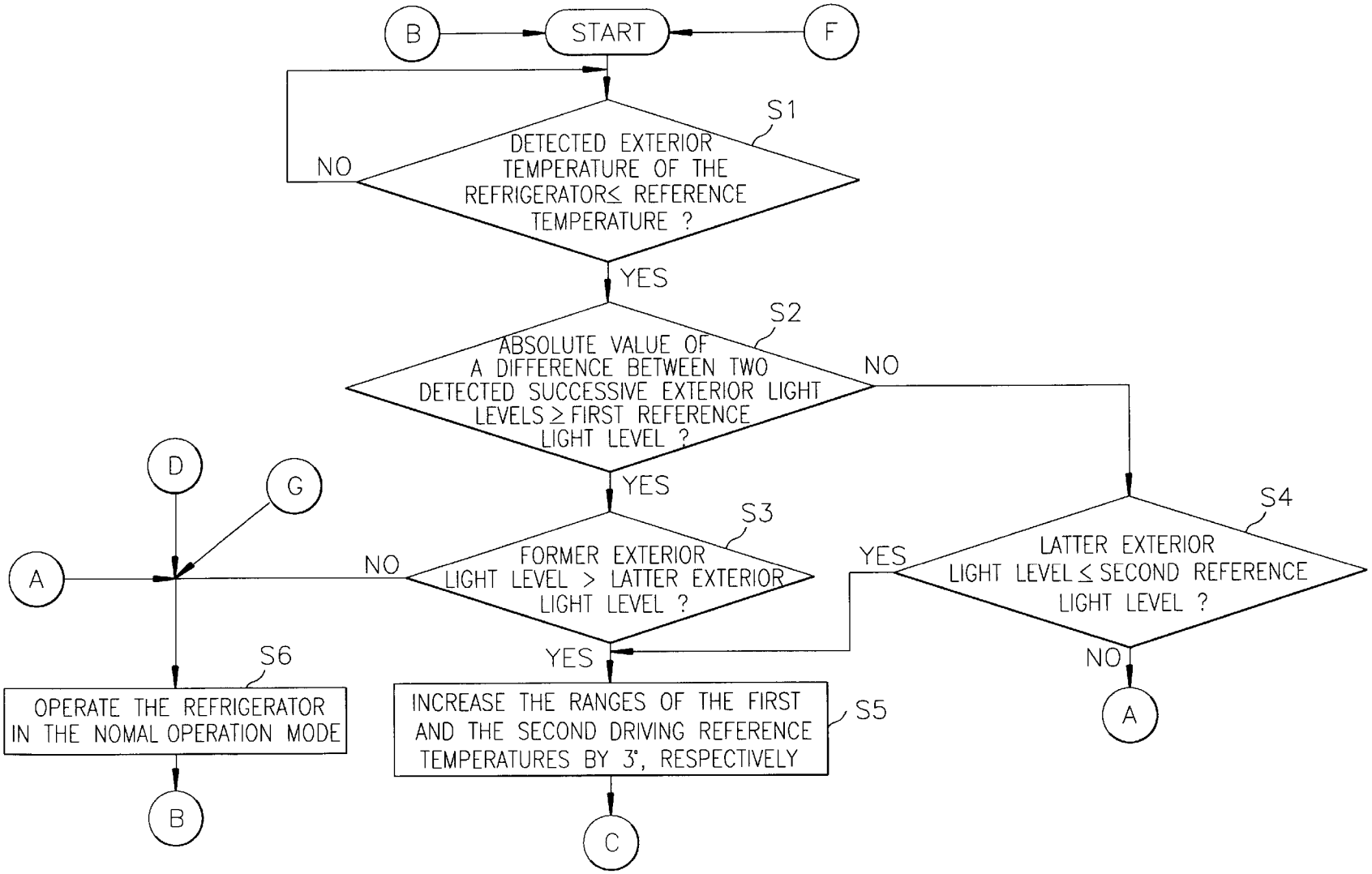
FIGS. 2A to 2C describe flow charts illustrating an inventive method for operating the refrigerator at a reduced noise level.
Figure 2B:
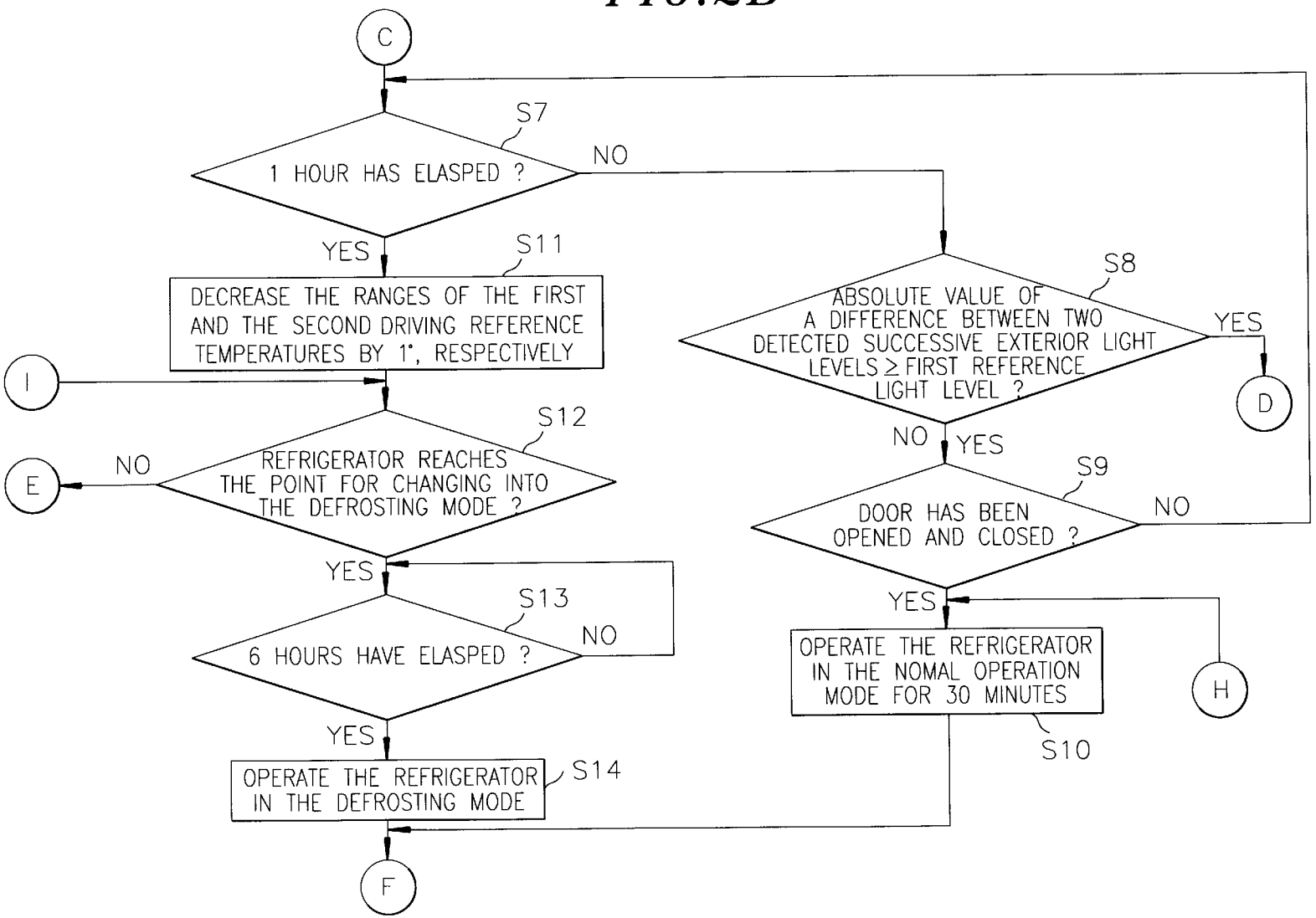
Figure 2C:
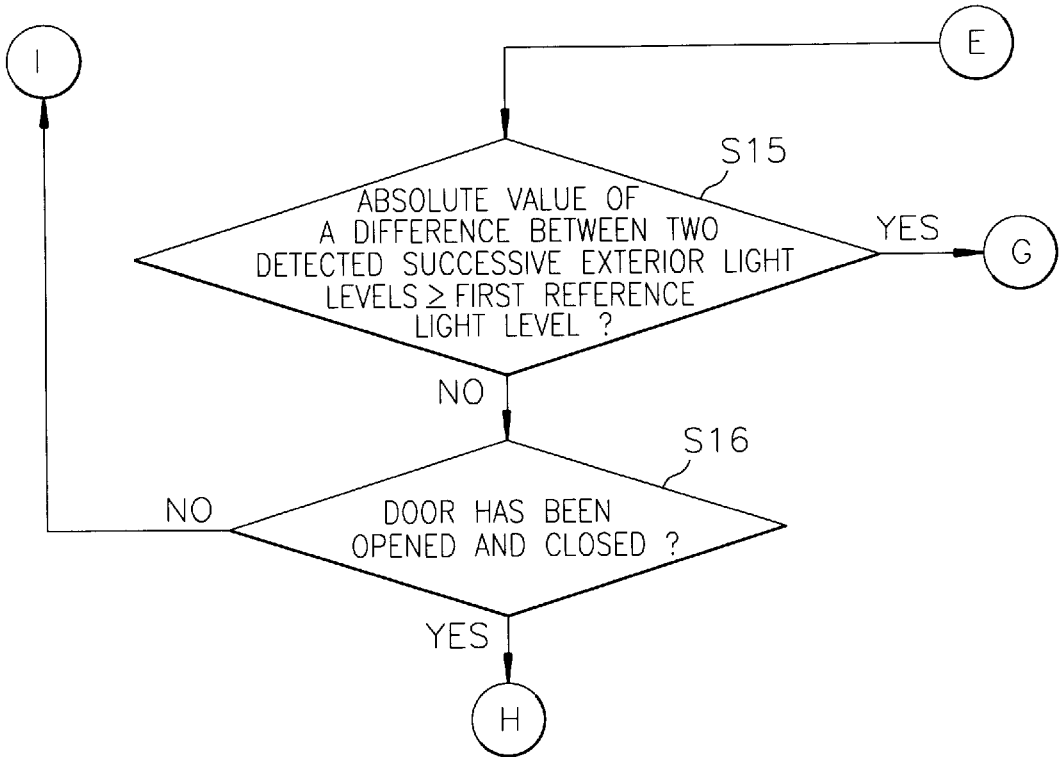

Referring to FIGS. 2A to 2C, there are described flow charts illustrating an inventive method for operating the refrigerator at the reduced noise level.

First, under the normal operation mode, the microcomputer 50 determines whether or not the exterior temperature of the refrigerator detected by the third temperature detecting unit 30 is less than or equal to a reference temperature, for example, 35° C., (step S1 shown in FIG. 2A), wherein, if the exterior temperature is less than or equal to the reference temperature, the process proceeds to step S2, but if not, returns to the start.

At step S2, the microcomputer 50 determines whether or not the absolute value of a difference between two successive exterior light levels of the refrigerator detected by the light level detecting unit 40 is more than or equal to the first reference light level, for example, 500 LUX. The first reference light level is used for measuring a variation of the exterior light levels of the refrigerator with time. If the absolute value of the difference between two successive exterior light levels of the refrigerator is more than or equal to the first reference light level, the process goes to step S3, but if not, the microcomputer 50 recognizes that the light levels are naturally changed, proceeding the process to step S4.

At step S3, the microcomputer 50 decides whether or not the former of two successive exterior light levels detected by the light level detecting unit 40 is more than the latter, wherein, if the former is more than the latter, the microcomputer 50 recognizes that the user has turned off the light at night, proceeding the process to step S5 so as to operate the refrigerator in the low noise operation mode which will be described in later, but if not, the microcomputer 50 recognizes that the user has turned on the light at night, proceeding the process to step S6.

At step S4, the microcomputer 50 decides whether or not the latter of two detected successive exterior light levels of the refrigerator is less than or equal to a second reference light level, for example, 100 LUX. If the latter is less than or equal to the second reference light level, the microcomputer 50 recognizes that it is nighttime, proceeding the process to step S5, but if not, the microcomputer 50 recognizes that it is daytime, proceeding the process to the above mention step S6 via a tap A.

At step S6, the microcomputer 50 allows the refrigerator to operate in the normal operation mode and the process to return to the start via a tap B. Under the normal operation mode, when the interior temperature of the refrigerator compartment detected by the first temperature detecting unit 10 is less than the minimum temperature in the range of the first driving reference temperature, the microcomputer 50 does not output the driving signal to the first fan driving unit 60, while when the interior temperature of the refrigerator compartment is more than the maximum temperature therein, the microcomputer 50 outputs the driving signal to the first fan driving unit 60, which, in turn, activates the first fan 70, blowing the cooling air around the evaporator to the refrigerator compartment. Similarly, when the interior temperature of the freezer compartment detected by the second temperature detecting unit 20 is less than a minimum temperature in range of the second driving reference temperature, the microcomputer 50 does not output the driving signals to the compressor driving unit 100 and the second fan driving unit 80, while when the interior temperature of the freezer compartment is more than the maximum temperature therein, the microcomputer 50 outputs the compressor driving signal to the compressor driving unit 100 and after, about 1 minute, outputs the second fan driving signal to the second fan driving unit 80, which, in turn, activates the compressor 110 and the second fan 90, blowing the cooling air around the evaporator to the freezer compartment.

On the other hand, at step S5, the ranges of the first and the second driving reference temperatures are, respectively, reset so as to be increased, for example, by 3° C. To be more specific, the ranges of the first and the second driving reference temperatures are reset so as to have from about 2° C. to about 3.65° C. and from about −19.5° C. to about −14.5° C., respectively, which, in turn, reduces the operating rate of the compressor 110, thereby lowering the operating noise thereof. Next, the process proceeds to step S7 shown in FIG. 2B via a tap C.

At step S7, the microcomputer 50 estimates whether or not a predetermined time, for example, 1 hour has elapsed, wherein, if 1 hour has elapsed, the process proceeds to step S11, but if not, the process goes to step S8.

At step S8, the microcomputer 50 determines again whether or not the absolute value of the difference between two successive exterior light levels of the refrigerator is more than or equal to the first reference light level. If the absolute value is more than or equal to the first reference light level, the microcomputer 50 recognizes that the user has turned on the light, returning the process to step S6 shown in FIG. 2A via a tap D, but if not, the microcomputer 50 recognizes that the exterior light levels are naturally changed, proceeding the process to step S9.

At step S9, the microcomputer 50 determines on the basis of the sensed result from the door sensing unit 45 whether or not the refrigerator door has been opened and closed, wherein, if the refrigerator door has been opened and closed, thee process proceeds to step S10, but if not, the process returns to step S7.

At step S10, after operating the refrigerator in the normal operation mode for about 30 minutes, the process returns to the start via a tap F and then decides whether it is daytime or nighttime, again.

On the other hand, at step S11, the ranges of the first and the second driving reference temperatures are, respectively, reset so as to be decreased, for example, by 1° C. To be more specific, the ranges of the first and the second driving reference temperatures are reset so as to have from about 1° C. to about 2.65° C. and from about −20.5° C. to about −15.5° C., respectively. As a result of this, the first and the second fans 70, 90 and the compressor 110 are operated at a relatively smaller operating rate than in the normal operation mode, respectively.

After that, at step S12, the microcomputer 50 determines whether or not the refrigerator reaches the point for changing into the defrosting mode, wherein, if the refrigerator reaches the point for changing into the defrosting mode, the process proceeds to step S13, but if not, the process goes to step S15 shown in FIG. 2C via a tap E.

At step S13, the microcomputer 50 checks whether or not a predetermined time, for example, 6 hours have elapsed, wherein, only if 6 hours have elapsed, the process proceeds to step S14 to remove the frost deposited on the evaporator. As described above, although the refrigerator reaches the point for changing into the defrosting mode at step S12, the microcomputer 50 delays for 6 hours the start point of the defrosting mode at step S13, operating the compressor 110 at the minimum operating rate. Thereafter, the process returns to the start via the tap F and then decides whether it is daytime or nighttime, again.

At step S15 shown in FIG. 2C, the microcomputer 50 determines once more whether or not the absolute value of the difference between two successive exterior light levels of the refrigerator is more than or equal to the first reference light level. If the absolute value is more than or equal to the first reference light level, the microcomputer 50 recognizes that the user has turned on the light, returning the process to step S6 shown in FIG. 2A via a tap G, but if not, the microcomputer 50 recognizes that the exterior light levels are naturally changed, proceeding the process to step S16.

At step S16, the microcomputer 50 determines on the basis of the sensed result from the door sensing unit 45 whether or not the refrigerator door has been opened and closed, wherein, if the refrigerator door has been opened and closed, the process proceeds to step S10 shown in FIG. 2B via a tap H, but if not, the process returns to step S12 shown in FIG. 2B via a tap I.

In such a method, by selectively controlling the operating rates of the fans and the compressor on the basis of the conditions surrounding the refrigerator such as turning on or off the light, opening and closing the refrigerator door, and properly delaying the start point of the defrosting mode, it is possible to reduce operating noise of the refrigerator at nighttime and the consumption power thereof.

Although the invention has been shown and described with respect to the preferred embodiments, it will be understood by those skilled in the art that various changes and modifications may be made without departing from the scope of the invention as defined in the following claims.

What is claimed is:

1. Method for reducing operating noise of a refrigerator comprising steps of:

(a) detecting an exterior temperature;

(b) comparing the detected the exterior temperature with a reference temperature;

(c) if the detected exterior temperature is less than or equal to the reference temperature, periodically detecting exterior light levels;

(d) determining whether or not an absolute value of the difference between two successive exterior light levels is more than or equal to a reference light level to thereby measure a variation of the exterior light levels with time;

(e) if the absolute value of the difference between two successive exterior light levels is more than or equal to the first reference light level, deciding whether or not the former is more than the latter, wherein, if the former is less than or equal to the latter, operating the refrigerator in a normal operation mode; and (f) if the former is more than the latter, increasing by a predetermined temperature a first driving reference temperature for driving a first fan for a refrigerator compartment and a second driving reference temperature for driving a compressor and a second fan for a freezer compartment, respectively, and operating the refrigerator at a reduced noise level.

2. The method of claim 1, further comprising steps of (g) estimating whether or not a predetermined time has elapsed, after step (f), wherein, if a predetermined time has elapsed, decreasing by a predetermined temperature the increased first and second driving reference temperatures, respectively, and (h) checking whether or not the refrigerator reaches the point for changing into a defrosting mode.

3. The method of claim 2, further comprising steps of (h1) if the refrigerator reaches the point for changing into a defrosting mode, delaying the start point of the defrosting mode for a predetermined time.

4. The method of claim 2, further comprising steps of (h2) if the refrigerator does not reaches the point for changing into the defrosting mode, determining again whether or not the absolute value of the difference between two successive exterior light levels is more than or equal to the first reference light level, wherein, if the absolute value of the difference between two successive exterior light levels is more than or equal to the first reference light level, operating the refrigerator in the normal operation mode, but if not, determining whether or not the refrigerator door has been opened and closed, wherein, if the refrigerator door has been opened and closed, operating the refrigerator in the normal operation mode for a predetermined time, but if not, proceeding the process to step (h).

5. The method of claim 2, further comprising step of (g1) if a predetermined time has not elapsed, determining whether or not the absolute value of the difference between two successive exterior light levels is more than or equal to the first reference light level, and (g2) if the absolute value is more than or equal to the first reference light level, operating the refrigerator in the normal operation mode, but if not, determining whether or not the refrigerator door has been opened and closed, wherein, if the refrigerator door has not been opened and closed, proceeding the process to step (g), but if the refrigerator door has been opened and closed, operating the refrigerator in the normal operation mode for a predetermined time.

6. Method for operating a refrigerator in a low noise comprising steps of:

detecting an exterior temperature;

comparing the detected the exterior temperature with a reference temperature;

if the detected exterior temperature is less than or equal to the reference temperature, periodically detecting exterior light levels;

determining whether or not an absolute value of the difference between two successive exterior light levels is more than or equal to a first reference light level to thereby measure a variation of the exterior light levels with time;

if the absolute value of the difference between two successive exterior light levels of the refrigerator is less than the first reference light level, deciding whether or not the latter is less than or equal to a second reference light level; and if the latter is less than or equal to the second reference light level, increasing by a predetermined temperature a first driving reference temperature for driving a first fan for a refrigerator compartment and a second driving reference temperature for driving a compressor and a second fan for a freezer compartment, respectively, and operating the refrigerator at a reduced noise level.

* * * * *